US012312909B2

(12) United States Patent
Mhaskar et al.

(10) Patent No.: US 12,312,909 B2
(45) Date of Patent: May 27, 2025

(54) SYNCHRONIZED ACTUATOR HAVING MULTIPLE MOTORS FOR DOWNHOLE WELL TOOL

(71) Applicant: Weatherford Technology Holdings, LLC, Houston, TX (US)

(72) Inventors: Nauman H. Mhaskar, Houston, TX (US); Don A. Hopmann, Alvin, TX (US); Sebastiaan J. Wolters, Kingwood, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 26 days.

(21) Appl. No.: 18/099,925

(22) Filed: Jan. 21, 2023

(65) Prior Publication Data

US 2024/0247565 A1 Jul. 25, 2024

(51) Int. Cl.
*E21B 34/06* (2006.01)
*E21B 43/12* (2006.01)

(52) U.S. Cl.
CPC ..... *E21B 34/066* (2013.01); *E21B 43/12* (2013.01); *E21B 2200/06* (2020.05)

(58) Field of Classification Search
CPC ..... E21B 35/066; E21B 34/14
See application file for complete search history.

(56) References Cited

U.S. PATENT DOCUMENTS 2,679,559 A 5/1954 Morris et al.
4,207,565 A 6/1980 Isakson et al.
4,251,698 A 2/1981 Raab et al.
4,373,582 A 2/1983 Bednar et al.
4,403,664 A 9/1983 Sullinger
4,693,131 A 9/1987 Teramachi
5,547,029 A 8/1996 Rubbo et al.
5,646,495 A 7/1997 Toyozawa et al.
5,674,169 A 10/1997 Yang
(Continued)

FOREIGN PATENT DOCUMENTS

WO 2005111484 A2 11/2005
WO 2007116264 A1 10/2007
(Continued)

OTHER PUBLICATIONS

International Search Report and Written Opinion in counterpart PCT/US2023/035789 mailed Feb. 12, 2024.

*Primary Examiner* — Tara Schimpf
*Assistant Examiner* — Ursula Lee Norris
(74) *Attorney, Agent, or Firm* — Cabello Hall Zinda, PLLC

(57) ABSTRACT

A downhole tool, such an interval control valve, for use in a well has multiple motors and two drive assemblies to displace a yoke. A member, such as a sliding sleeve, of the downhole tool is connected to the yoke and can be actuated in response to the displacement of the yoke. The drive assemblies include first and second rotatable screws, and the yoke is disposed on the screws. Each motor can produce drive to rotate a respective screw. A respective gear is rotatable in association with at least the rotation of its associated screw. An intermediate gear is engaged between these two gears. The intermediate gear interconnects the rotation of the two screws, forcing them to rotate at the same speed. Likewise, the intermediate gear balances the drive of the motors, forcing the two screws to rotate at the same speed.

21 Claims, 9 Drawing Sheets

(56) References Cited

U.S. PATENT DOCUMENTS

| | | | | |
|---|---|---|---|---|
| 5,744,877 | A | 4/1998 | Owens | |
| 5,941,307 | A | 8/1999 | Tubel | |
| 6,041,857 | A | 3/2000 | Carmody et al. | |
| 6,237,683 | B1 | 5/2001 | Pringle et al. | |
| 6,276,458 | B1 | 8/2001 | Malone et al. | |
| 6,334,486 | B1 | 1/2002 | Carmody et al. | |
| 6,364,023 | B1 | 4/2002 | Hiron et al. | |
| 6,509,732 | B1 | 1/2003 | Rhodes et al. | |
| 6,698,313 | B2 | 3/2004 | Gaffney et al. | |
| 6,968,145 | B2 | 11/2005 | Kishigami | |
| 7,222,682 | B2 * | 5/2007 | Doering | F16H 7/06 74/424.93 |
| 7,673,683 | B2 | 3/2010 | Gissler | |
| 7,675,253 | B2 * | 3/2010 | Dorel | E21B 34/066 166/65.1 |
| 7,779,912 | B2 | 8/2010 | Gissler | |
| 7,828,066 | B2 | 11/2010 | Jahn | |
| 8,049,128 | B1 | 11/2011 | Witt | |
| 8,836,325 | B2 | 9/2014 | Prost et al. | |
| 9,114,252 | B2 | 8/2015 | Yu et al. | |
| 9,242,181 | B2 | 1/2016 | Vatcher et al. | |
| 11,371,318 | B2 | 6/2022 | Hopmann et al. | |
| 2005/0263280 | A1 | 12/2005 | Sellers et al. | |
| 2011/0100471 | A1 | 5/2011 | Schroeder et al. | |
| 2016/0047205 | A1 | 2/2016 | Head | |
| 2016/0047209 | A1 | 2/2016 | Castillo et al. | |
| 2016/0108858 | A1 | 4/2016 | Miyahara et al. | |
| 2020/0340562 | A1 * | 10/2020 | Eriksen | F16K 31/508 |
| 2021/0062614 | A1 * | 3/2021 | Hopmann | F16H 25/24 |

FOREIGN PATENT DOCUMENTS

| | | | |
|---|---|---|---|
| WO | 2014065820 | A1 | 5/2014 |
| WO | 2019078727 | A1 | 4/2019 |

* cited by examiner

SYNCHRONIZED ACTUATOR HAVING MULTIPLE MOTORS FOR DOWNHOLE WELL TOOL

FIELD OF THE DISCLOSURE

The subject matter of the present disclosure is directed generally to equipment utilized and operations performed in conjunction with a subterranean well. More particularly, the subject matter of the present disclosure discloses a well tool, such as electric interval control valve, and discloses an actuator for a well tool, the actuator having multiple motors and dual roto-linear drives and using a combined gear train and couplings for the motors and drives to offer speed synchronization.

BACKGROUND OF THE DISCLOSURE

Many different types of downhole well tools can be actuated in a well. Valves, packers, fluid samplers, formation testers, pumps, inflow control devices, and perforators are a few examples. In some situations, it is desirable to electrically actuate the downhole well tools using electrical power supplied from surface.

In a typical well tool, a single motor and a ball screw are used for an electric actuator so there are no motor synchronization problems. However, the use of dual motors allows a higher load rating to be achieved with the electric actuator. Additionally, to achieve similar load ratings, the dual motors can be smaller and can be packaged in a smaller housing compared to a relatively larger single motor arrangement. Unfortunately, using dual motors for an electric actuator in a well tool can be problematic if the speeds of the motors are not identical. The lack of synchronization between the motors can result in the actuator seizing up.

The subject matter of the present disclosure is directed to overcoming, or at least reducing the effects of, one or more of the problems set forth above.

SUMMARY OF THE DISCLOSURE

A downhole tool is disclosed herein for use in a well. The downhole tool comprises first and second screws, first and second motors, a yoke, and an actuatable member. The respective first and second screws are rotatable with respective first and second rotations, and the respective first and second motors are configured to produce respective first and second drives to rotate the first and second screws. The yoke is disposed on the first and second screws and is displaceable thereon by at least one of the first and second drives. The actuatable member of the downhole tool is connected to the yoke and is actuatable in response to the displacement of the yoke.

The downhole tool comprises a gear train. A first gear of the train is rotatable in association with at least the first rotation, and a second gear of the train is rotatable in association with at least the second rotation. An intermediate gear of the train is engaged between the first and second gears and is configured to synchronize the first and second rotations.

Another downhole tool disclosed herein for use in a well comprises at least one roto-linear drive, at least two motors, a mechanical system, a yoke, and a member. The at least two motors are each configured to produce rotation in the at least one roto-linear drive, and the mechanical system is configured to synchronize the rotation produced between the at least two motors. The yoke is disposed on the at least one roto-linear drive and is displaceable thereon by the rotation. The member of the downhole tool is connected to the yoke and is actuatable in response to the displacement of the yoke.

For example, the downhole tool can comprise first and second roto-linear drives, first and second motors, a yoke, and an actuatable member. The respective first and second motors are configured to operate the respective first and second roto-linear drives. The yoke is disposed on the first and second roto-linear drives and is displaceable thereon by the operation of at least one of the first and second roto-linear drives. The actuatable member of the downhole tool is connected to the yoke and is actuatable in response to the displacement of the yoke. The downhole tool comprises a mechanical system configured to synchronize rotation of the first and second roto-linear drives. In a preferred embodiment, the mechanical system comprises a gear train having a plurality of interconnected gears.

An actuator is disclosed herein for actuating a member of a downhole tool used in a well. The actuator comprises at least two motors, at least one screw, a mechanical system, and a yoke. A first of the at least one motor can be configured to produce a first drive, and a second of the at least one motor can be configured to produce a second drive. The at least one screw is rotatable in association with at least one of the first and second drives. The yoke is disposed on the at least one screw and is displaceable thereon by at least one of the first and second drives.

The mechanical system is configured to synchronize the rotation produced between the at least two motors. A first gear of the system is rotatable in association with the first drive, and a second gear of the system is rotatable in association with the second drive. An intermediate gear of the system is engaged between the first and second gears and is configured to synchronize the first and second drives.

For example, the actuator can comprise first and second screws, first and second motors, the yoke, and the mechanical system. The respective first and second screws are rotatable with respective first and second rotation. The respective first and second motors are configured to produce respective first and second drives to rotate the respective first and second screws. The yoke is disposed on the first and second screws and is displaceable thereon by at least one of the first and second drives. The first gear of the system is rotatable in association with at least the first rotation, and the second gear of the system is rotatable in association with at least the second rotation. The intermediate gear of the system is engaged between the first and second gears and is configured to synchronize the first and second rotations.

The foregoing summary is not intended to summarize each potential embodiment or every aspect of the present disclosure.

DETAILED DESCRIPTION OF THE DISCLOSURE

Figure 1:
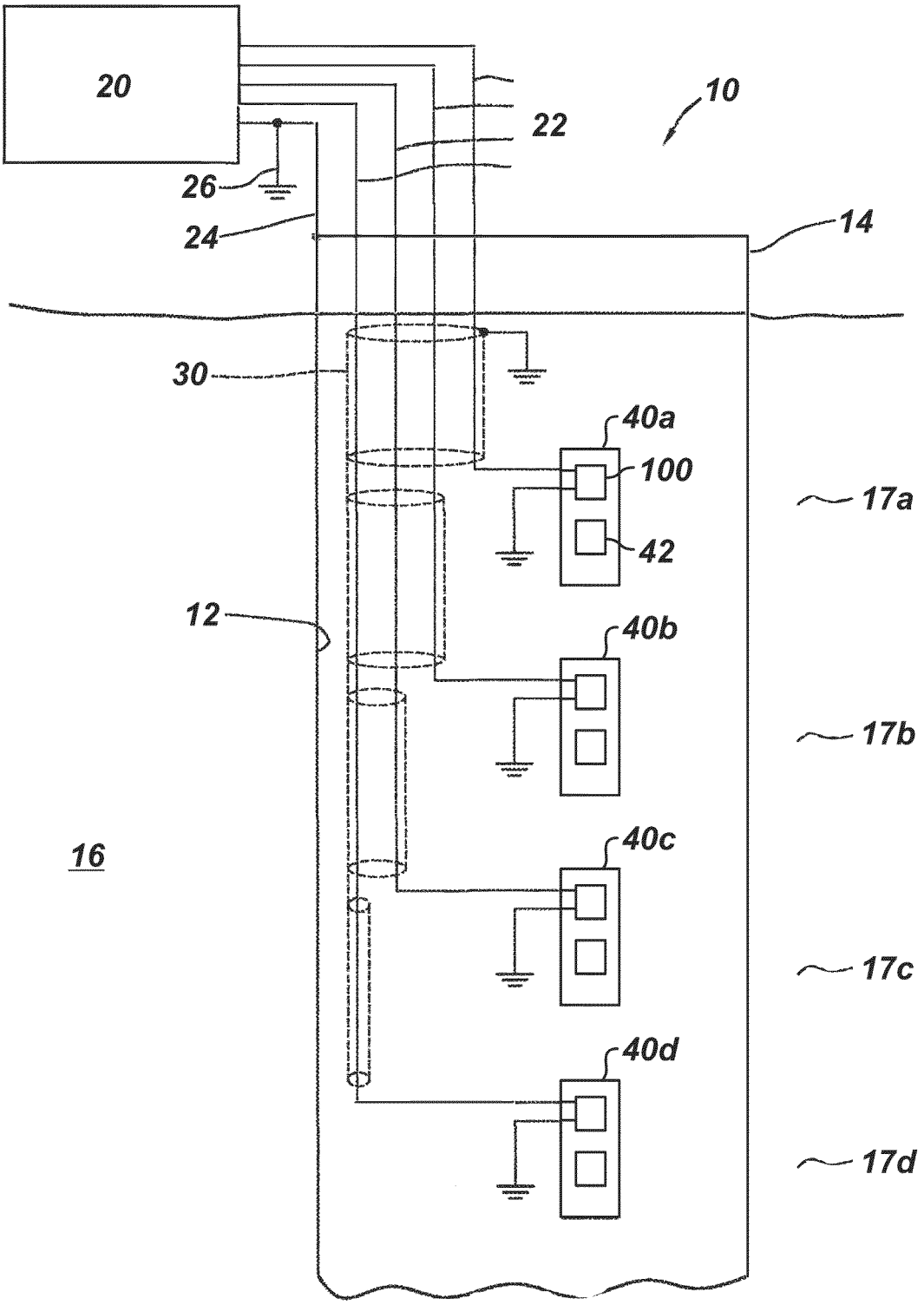
FIG. 1 illustrates a schematic view of a well system according to the present disclosure.

FIG. 1 is a schematic view of a well system 10 for use with a wellbore 12 drilled into a reservoir formation 16. Well tools 40*a-b* are disposed in the wellbore 12. In one arrangement, the well tools 40*a-b* can control flow of fluid between the wellbore 12 and each of multiple isolated intervals or zones 17*a-d*. For example, the well tools 40*a-b* of the present disclosure can be multi-position flow control devices, such as interval control valves, and each can have an actuatable member 42 and an actuator 100. The interval control valves 40*a-b* can provide selective production from, or injection into, the isolated intervals or zones 17*a-d* in the wellbore 12. Although the present example shows and describes interval control valves for the well tools 40*a-d*, any type of downhole well tool that can be actuated between positions or configurations (such as, opened or closed, set or unset, extended or retracted, etc.) downhole can benefit from the principles of this disclosure. Thus, the scope of the present disclosure is not limited to downhole interval control valves, but instead is applicable to a wide variety of different downhole well tools, such as a valve, a packer, a fluid sampler, a formation tester, a pump, an inflow control device, a safety valve, and an interval control valve.

As noted above, the interval control valves 40*a-d* are electrically operated and are installed in the wellbore 12 to selectively control production from, or injection into, the respective individual zones 17*a-d*. As is typical, the valves 40*a-d* can be connected on a tubular string (such as, a production or injection tubing string) for flowing the fluid between the surface and each of the valves 40*a-d*.

Each valve 40*a-d* can be individually powered and controlled by a system controller 20 via a respective individual conductor 22. The system 10 can utilize multi-core Tubing Encased Conductors (TEC's) 30 to minimize the number of lines required to connect the well tools 40*a-d* to surface. Although not shown here, a portion of the system controller 20 can be positioned below a tubing hanger in a wellhead 14 to minimize the number of electrical connections required to pass through the tubing hanger. The system controller 20 is commonly grounded to the wellbore 12 (such as, via the metal casing that lines the wellbore), to the wellhead 14 via a conductor 24, to the metal armor encasing of the TEC 30 for the conductors 22 within the wellbore 12, and to other possible points.

As generally shown, each of the valves 40*a-d* has an actuator 100 and an actuatable member 42. The actuator 100 is configured to move, displace, or change the position, state, orientation, etc. of the actuatable member 42. For its part, the actuatable member 42 can change the flow of fluid between the valve 40*a-d* and the wellbore 12, such as by opening and closing fluid communication through the valves 40*a-d*.

Figure 2:
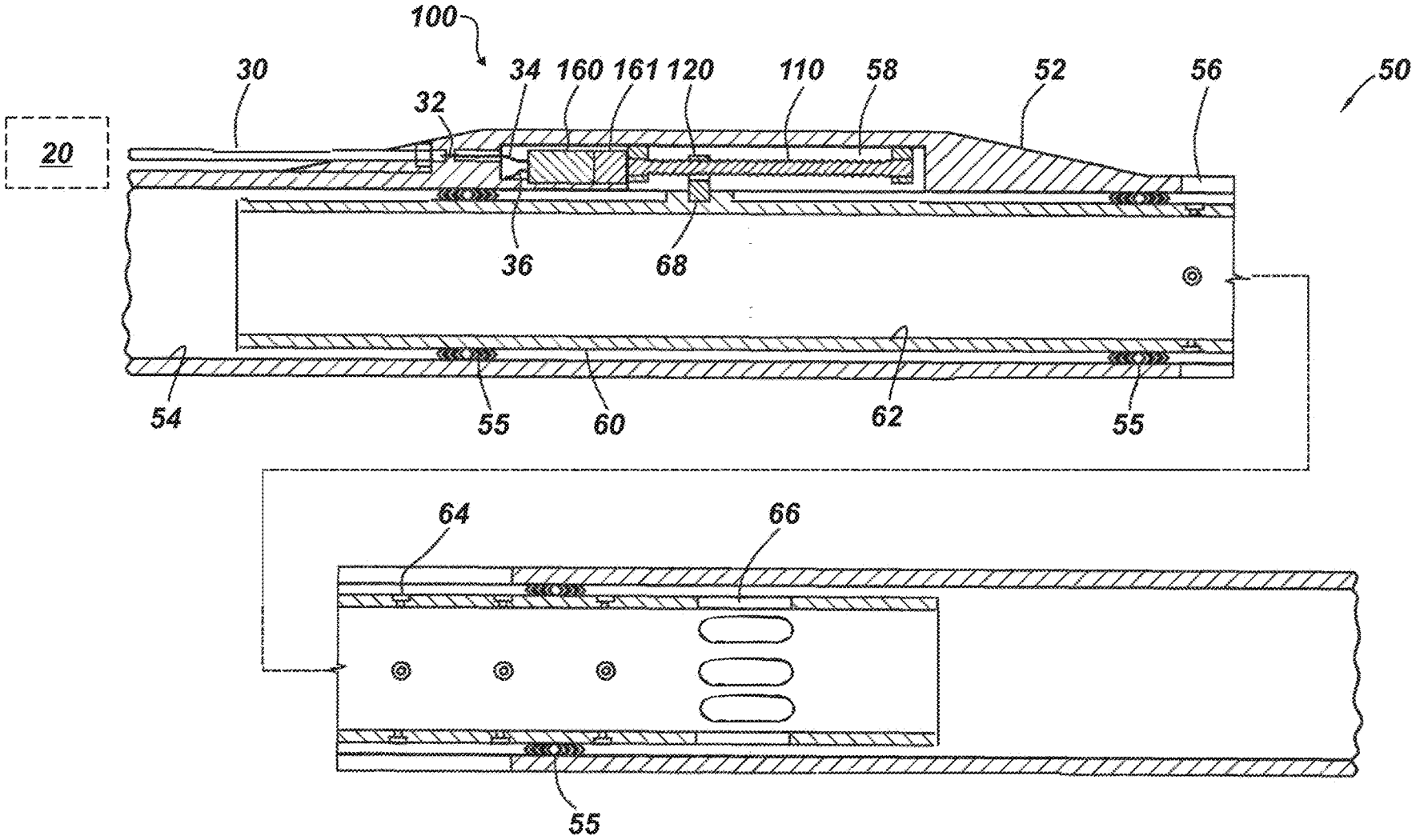
FIG. 2 illustrates a cross-sectional view of an example downhole well tool having an actuator according to the present disclosure.

As a particular example, FIG. 2 is a simplified cross-sectional view of a well tool 50 having an actuator 100 of the present disclosure. As noted above and as shown here, the well tool 50 can be an interval control valve.

The valve 50 includes a housing 52 having an internal bore 54 and includes an inner sleeve 60 having an internal passage 62. The inner sleeve 60 is disposed in the bore 54 and is engaged by seals 55 of the housing 52. The seals 55 isolate the tubing (e.g., the interior of the tubular string to which the valve 50 is mounted) from the wellbore annulus (e.g., an annulus formed between the tubular string and wellbore casing). Accordingly, the seals 55 isolate a pressure-compensated chamber 58 from the tubing. When flow ports 66 on the inner sleeve 60 are aligned with housing flow ports 56, the valve 50 permits fluid communication between the tubing and annulus (e.g., between the interior and the exterior of the valve 50).

The inner sleeve 60 is one example of an actuatable member that may be displaced when actuated. In this example, the inner sleeve 60 in a closed position closes off or otherwise blocks flow through the housing flow ports 56. By contrast, the inner sleeve 60 in an open position permits flow through the housing flow ports 56. Other types of actuatable members may be displaced, and the actuatable member may be displaced to other positions in other downhole well tools incorporating the principles of this disclosure.

The valve 50 uses an actuator 100 to move the inner sleeve 60. A conductor TEC 30 supplies power to the valve 50 from the system controller 20. A pressure bulkhead feedthrough 32 provides pressure isolation between the pressure compensated chamber 58 and an interior of the TEC 30. The conductor 34 of the TEC 30 is connected to one pole of the dual motors 160, and a second contact of the dual motors 160 is connected to ground at point 36.

The dual motors 160 may drive gear boxes 161, which in turn operate dual roto-linear drives 110, which can be ball screw assemblies. (In this side view, only one motor 160 and ball screw assembly 110 is visible.) The rotation of the ball screw assembly 110 produces linear motion of a ball nut 114, which is connected to the inner sleeve 60 by means of a load yoke or load lug 68. Thus, by supplying power to the motors 160, the inner sleeve 60 can be displaced to block or permit flow through the ports 66, 56.

A longitudinal direction of the inner sleeve 60 displacement corresponds to a polarity of the power applied to the motors 160. By switching the polarity, the inner sleeve 60 displacement direction can be reversed. For fully open and fully closed positions, the inner sleeve 60 bottoms-out at either end of its stroke. In some examples (such as, a multi-position, or choking interval control valve), the inner sleeve 60 can incorporate additional ports or orifices 64 that can align with the housing ports 56 when the inner sleeve 60 is in-between its full open and full closed positions. These in-between positions can be used to limit a flow area through the valve 50, which enables a unique desirable restricted, or choked, flow depending on what intermediate position is selected.

It is advantageous to have position feedback from a downhole flow control or interval control valve 50 during actuation to enable an operator and/or the system controller 20 to determine what state the valve 50 has (e.g., a position of the inner sleeve 60 in the valve 50 of FIG. 3A) during the actuation process. This is particularly important for a choking-type ICV as it allows the ICV actuation to be stopped at a desired choking setting (e.g., with a desired restriction to flow) and provides positive feedback to the system controller 20 and operator that the valve is in the correct choking configuration. Details of such a position indicating capability are disclosed in co-pending U.S. application Ser. No. 17/741,839 filed May 11, 2022, which is incorporated herein by reference in its entirety.

Figure 3A:
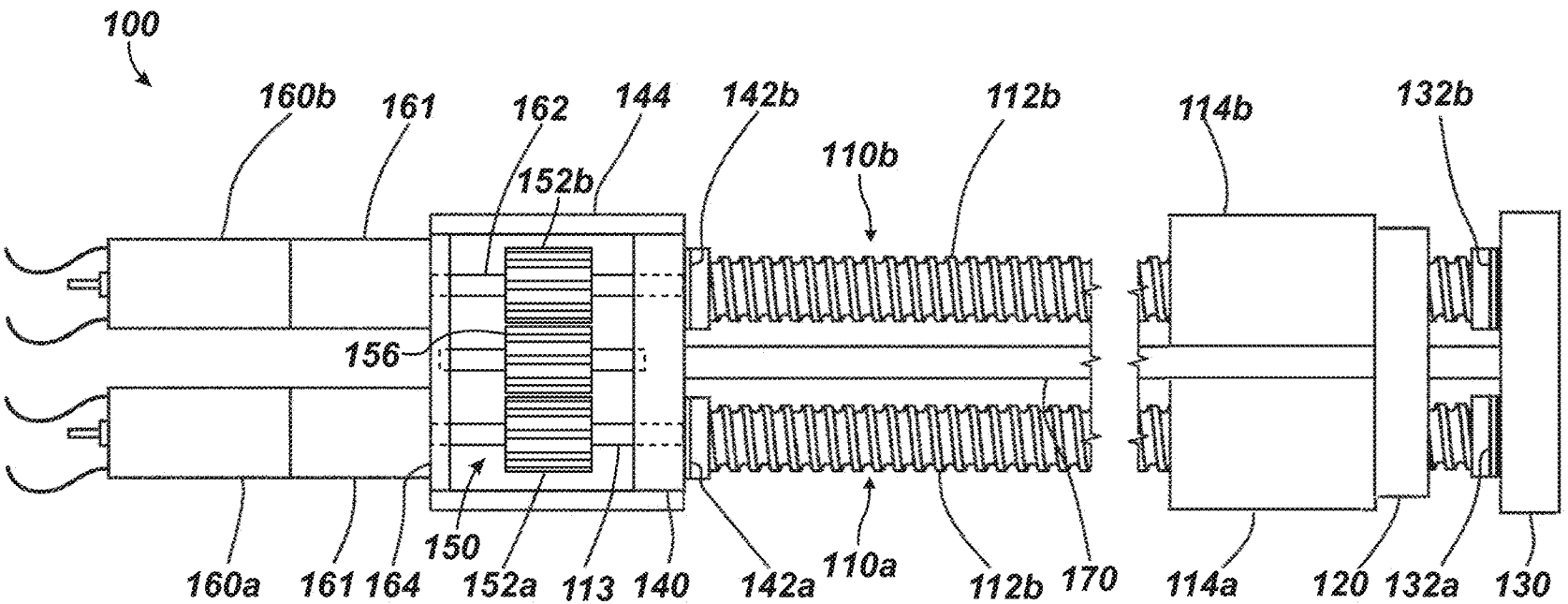
FIG. 3A illustrates a schematic view of one example of an actuator according to the present disclosure.

Having an understanding of an example well tool (e.g., an interval control valve) having an actuator 100 as disclosed herein to control an actuatable member (e.g., sleeve 60), FIG. 3A shows a more detailed view of an actuator 100 that can be used in the valve of FIG. 2 or another downhole well tool of the present disclosure.

The actuator 100 includes multiple motors 160*a-b* and dual roto-linear drives 110*a-b*. The motors 160*a-b* can be brushed DC motors as noted and produces rotation in drive shafts 162. As shown, the motors 160*a-b* can have gear boxes 161 for the drive shafts 162. The roto-linear drives 110*a-b* can be ball screw assemblies having rotatable screws 112*a-b* and ball nuts 114*a-b*. A mechanical system 150 is disposed between the motors 160*a-b* and the ball screws 110*a-b*. These components are assembled together by means of a torque plate or motor mount 164, an end support or mount 140, and support bars 144. The mechanical system 150 as shown here is a gear train having a set of interconnected gears 152*a-b*, 156. This gear-based system 150 is preferred because the gears 152*a-b*, 156 provide more precise interconnection between the rotations and have less "play" therebetween. As will be appreciated, other mechanical arrangements can be used for the mechanical system 150, such as a set of sprockets and interconnecting chain, a set of gears and interconnecting drive belt, and the like.

At the other end of the actuator 100, another end support or mount 130 supports the screws 112*a-b* of the ball screws 110*a-b*. Bearings 132*a-b*, 142*a-b* are used on the end supports 130, 140 to support axial and radial loads at ends of the screws 112*a-b*. The end supports 130, 140 can be securely mounted to the housing (52; FIG. 2) to transfer linear loads to a main body of a well tool, such as the ICV (50).

A load yoke 120 is rigidly connected to the ball nuts 114*a-b*. As noted, the load yoke 120 can be connected to an actuatable member, such as the inner sleeve (60; FIG. 2). Movement of the ball nuts 114*a-b* on the screws 112*a-b* transfers to liner motion the nuts 114*a-b*, connected yoke 120, and connected inner sleeve (60; FIG. 2). The yoke 120 can slide along a static position indicator bar 170 if present to provide feedback control of the actuation. The load yoke 120 and ball nuts 114*a-b* are the only components that move linearly in this example, and the direction of their linear displacement is determined by the rotation of one or both of the motors 160*a-b* (i.e., by polarity of the power supplied to one or both of the DC motors 160*a-b*).

As noted, the load yoke 120 is a member or structure that connects the actuator 100 to a member of a downhole well tool (such as the inner sleeve 60) to be displaced by the actuator 100. In the present examples, the load yoke 120 connects the ball nuts 114*a-b* of the actuator 100 to the inner sleeve (60) so that the actuator 100 can displace the inner sleeve (60).

The motors 160*a-b* and the ball screws 110*a-b* are arranged in parallel. Both motors 160*a-b*, gear boxes 161, and ball screws 110*a-b* rotate in the same direction when power is applied to the motors 160*a-b*. The dual load yoke 120 is rigidly connected to the ball nuts 114*a-b* on the respective screws 112*a-b*. The position indicator bar 170 is placed between the screws 112*a-b* of the two ball screws 110*a-b*, and the dual load yoke 120 slides along the length of bar 170.

The dual-motor example of the actuator 100 in FIG. 3A provides higher linear shifting forces, enhanced distribution of linear and radial loads across a higher number of components, and provides redundancy should one of the motors 160*a-b* or gear boxes 161 cease to operate. Both of the motors 160*a-b* can be supplied power via a single conductor, or each motor 160*a-b* can be powered by a separate conductor.

Viewed one way, the gear train 150 synchronizes/interconnects/mediates the drive produced between the motors 160*a-b* for the screws 112*a-b*. Viewed another way, the gear train 150 synchronizes/interconnects/mediates the rotation between the screws 112*a-b*. In general, the first motor 160*a* when operated produces a first drive to rotate the screw 112*a* of the first ball screw 110*a*, and the second motor 160*b* when operated produces a second drive to rotate the screw 112*b* of the second ball screw 110*b*. The screws 112*a-b* are rotatable.

A first gear 152*a* of the gear train 150 is rotatable in association with at least the rotation of the first screw 112*a*. This is true either when the first motor 160*a* drives the first screw 112*a* to rotate or when the drive of the second motor 160*b* produces rotation in the first screw 112*a* (i.e., via its connection with the second screw 112*b* through the ball nuts 114*a-b* on the yoke 120). In a similar fashion, a second gear 152*b* of the gear train 150 is rotatable in association with at least the rotation of the second screw 112*b*. This is true either when the second motor 160*b* drives the second screw 112*b* to rotate or when the drive of the first motor 160*a* produces rotation in the second screw 112*b* (i.e., via its connection with the first screw 112*a* through the ball nuts 114*a-b* on the yoke 120).

An intermediate gear 156 of the gear train 150 is engaged between the first and second gears 152*a-b* and is configured to synchronize/mediate/interconnect the drive/rotation between the first and second screws 112*a-b*.

The shafts 162 from the motors 160*a-b* can be connected to, coupled with, or the like, the ends 116*a-b* of the screws 112*a-b* so that rotation of the shafts 162 transfers to the screws 112*a-b*. The gears 152*a-b* can rotate with the transferred rotation. For example, in a preferred arrangement, each of the gears 152*a-b* tie one of the motors 160*a-b* and respective screws 112*a-b* together by spanning across both the motor shaft 162 and screw shaft 116 so the gears 152*a-b* act as both gears and couplings. Other arrangements can be used as long as the first and second gears 152*a-b* rotate respectively with the rotation of the associated screw 112*a-b* and the intermediate gear 156 is engaged between the gears 152*a-b*. The intermediate gear 156 can rotate with, about, or on its own axle or shaft.

The benefits of multiple motors and mechanical synchronization noted above can also be realized in an actuator having one roto-linear drive and at least two motors. In particular, FIGS. 3B-3C illustrate schematic views of other examples of an actuator 100 according to the present disclosure.

The actuator 100 includes dual motors 160*a-b*, a roto-linear drive 110, and a load yoke 120. The motors 160*a-b* produce rotation in drive shafts 162, and the motors 160*a-b* can have gear boxes 161 for the drive shafts 162. The roto-linear drive 110 can be a ball screw assembly having a rotatable screw 112 and a ball nut 114. As before, a mechanical system 150 is disposed between the motors 160*a-b* and the ball screw assembly 110.

The components of this actuator 100 can be similar to those discussed above. As shown, the mechanical system 150 is a gear train having a set of interconnected gears 152*a-b*, 156. Additionally, end supports or mounts 130, 140 support the rotatable screw 112 of the ball screw assembly 110, and bearings 132, 142 are used on the end supports 130, 140 to support axial and radial loads at ends of the rotatable screw 112. Finally, the load yoke 120 is rigidly connected to the ball nut 114. These and other features can be similar to the previous example.

Figure 3B:
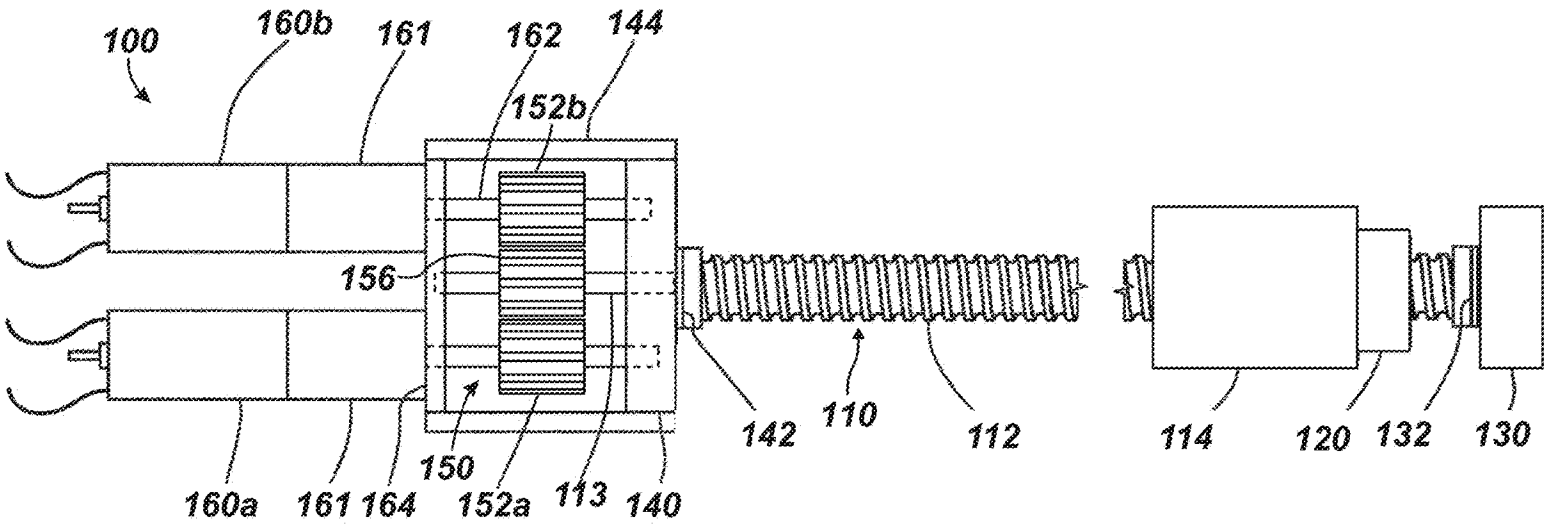
FIGS. 3B-3C illustrate schematic views of other examples of an actuator according to the present disclosure.
Figure 3C:
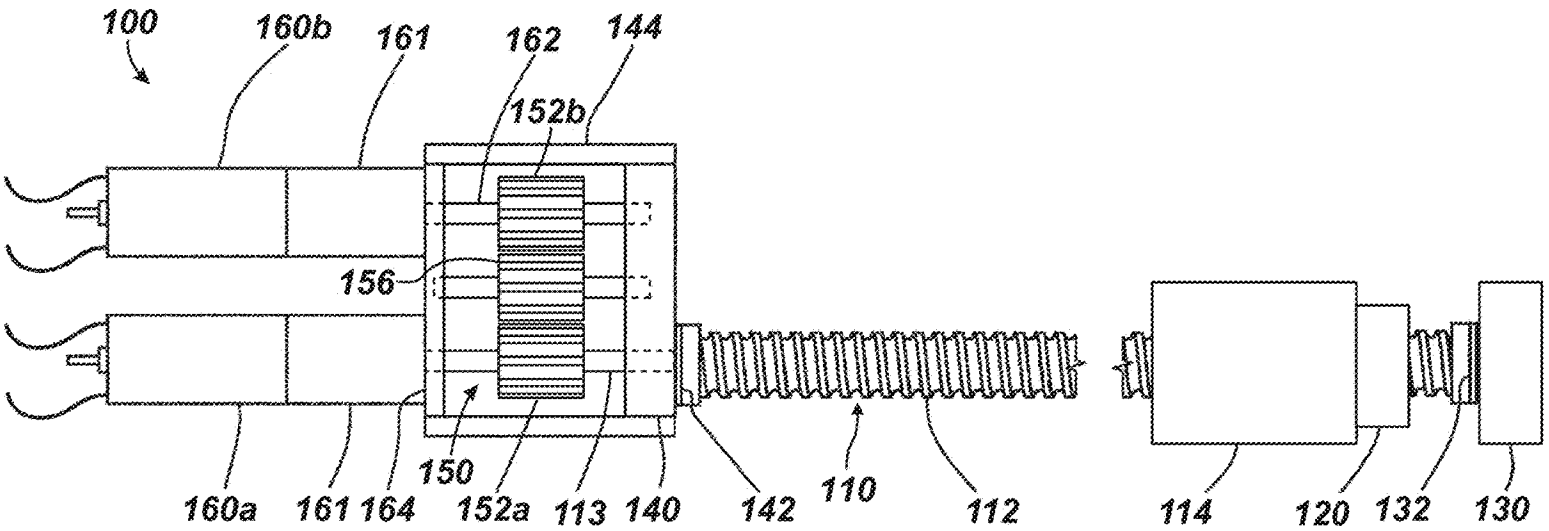

As before, the dual-motor actuator 100 in FIGS. 3B-3C provides higher linear shifting forces, enhanced distribution of linear and radial loads across a higher number of components, and provides redundancy should one of the motors 160*a-b* or gear boxes 161 cease to operate. Both of the motors 160*a-b* can be supplied power via a single conductor, or each motor 160*a-b* can be powered by a separate conductor.

During operation, the gear train 150 synchronizes/interconnects/mediates the drive produced between the motors 160*a-b* for the rotatable screw 112. In general, the first motor 160*a* when operated produces a first drive to rotate the rotatable screw 112 of the ball screw assembly 110, and the second motor 160*b* when operated produces a second drive to rotate the rotatable screw 112 of the ball screw assembly 110.

A first gear 152*a* of the gear train 150 is rotatable in association with the rotation of the rotatable screw 112. This is true either when the first motor 160*a* drives the rotatable screw 112 to rotate or when the drive of the second motor 160*b* produces rotation in the rotatable screw 112 (i.e., via its connection through the gear train 150). In a similar fashion, a second gear 152*b* of the gear train 150 is rotatable in association with the rotation of the rotatable screw 112. This is true either when the second motor 160*b* drives the rotatable screw 112 to rotate or when the drive of the first motor 160*a* produces rotation in the rotatable screw 112.

An intermediate gear 156 of the gear train 150 is engaged between the first and second gears 152*a-b* and is configured to synchronize/mediate/interconnect the drive/rotation between the first and second screws 112*a-b*. As shown in FIG. 3B, the axle for the intermediate gear 156 can be coupled to the rotatable screw 112, and the other gears 152*a-b* can rotate with, about, or on their own axles. Other arrangements can be used. In FIG. 3C, for example, the first gear 152*a* can couple the shaft 162 of the first motor 160*a* to the end 113 of the screw 112 so that rotation of the shaft 162 transfers to the screw 112 or vice versa. The shaft 162 from the second motor 160*a-b* can have the second gear 152*b* disposed thereon. The intermediate gear 156 engaged between the gears 152*a-b* can rotate with, about, or on its own axle or shaft.

Figure 4A:
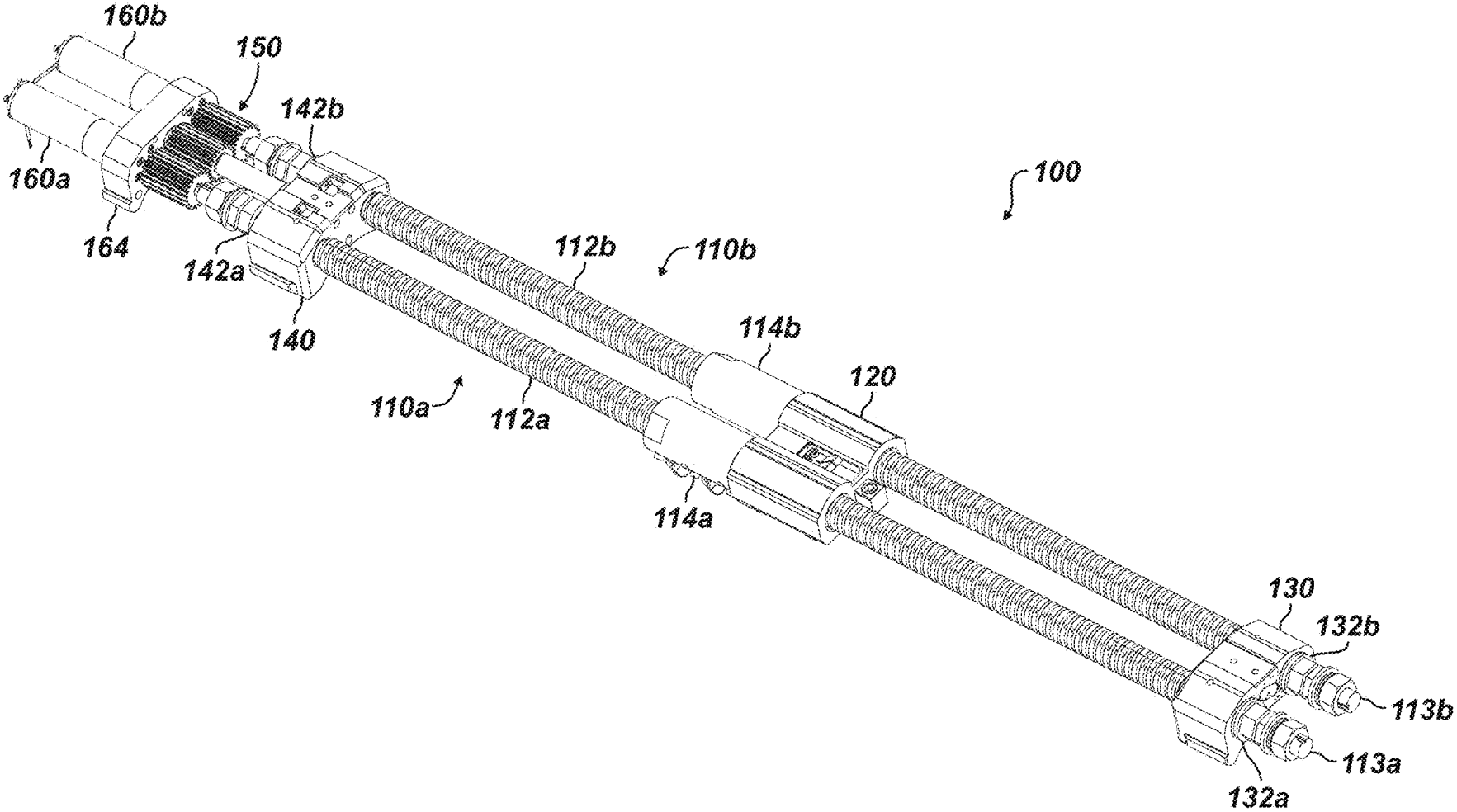
FIG. 4A illustrates a perspective view of another example of an actuator according to the present disclosure.
Figure 4B:
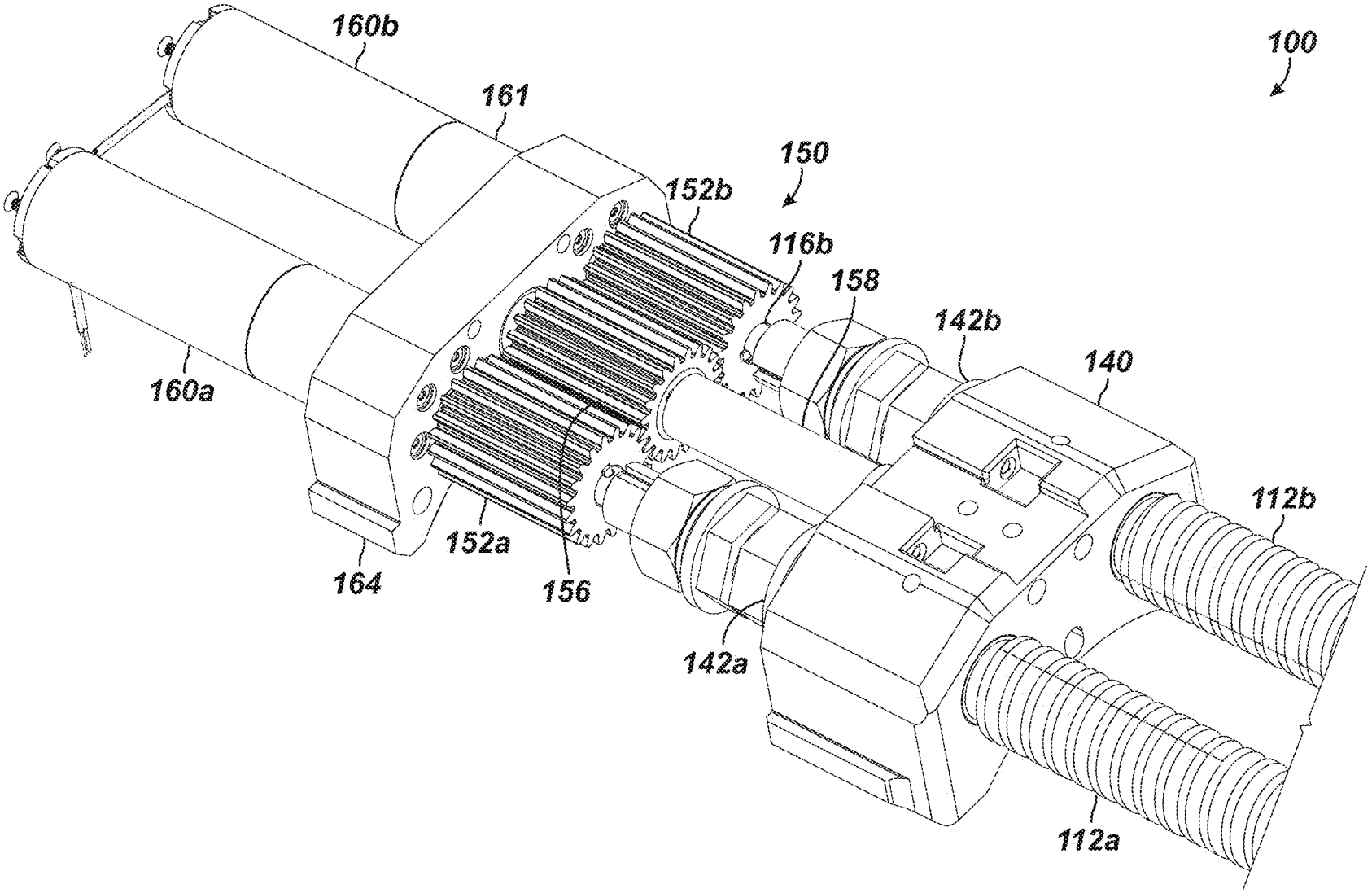
FIG. 4B illustrates a detail of the actuator in FIG. 4A.
Figure 4C:
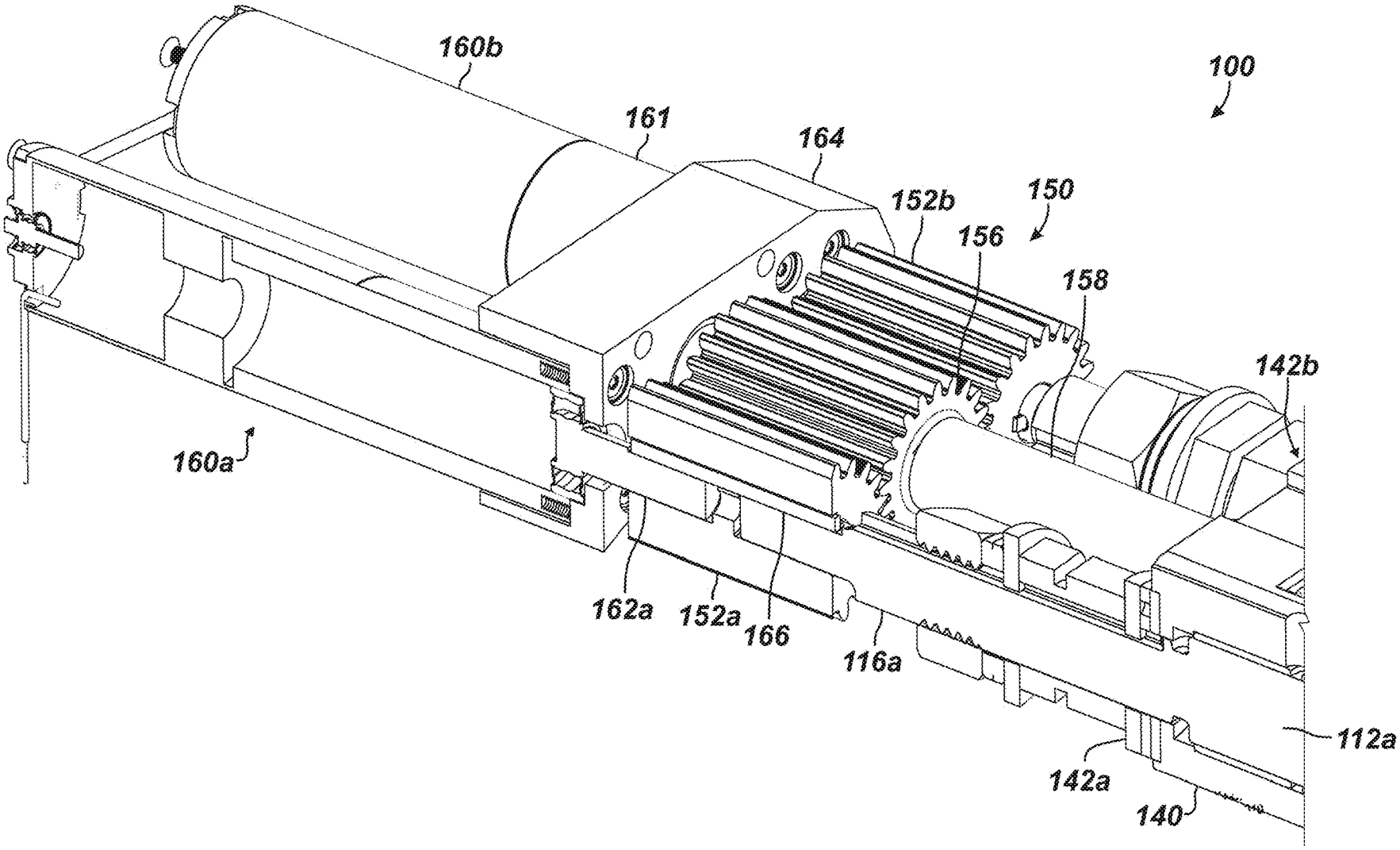
FIG. 4C illustrates a cross-section of the actuator in FIG. 4A.
Figure 4D:
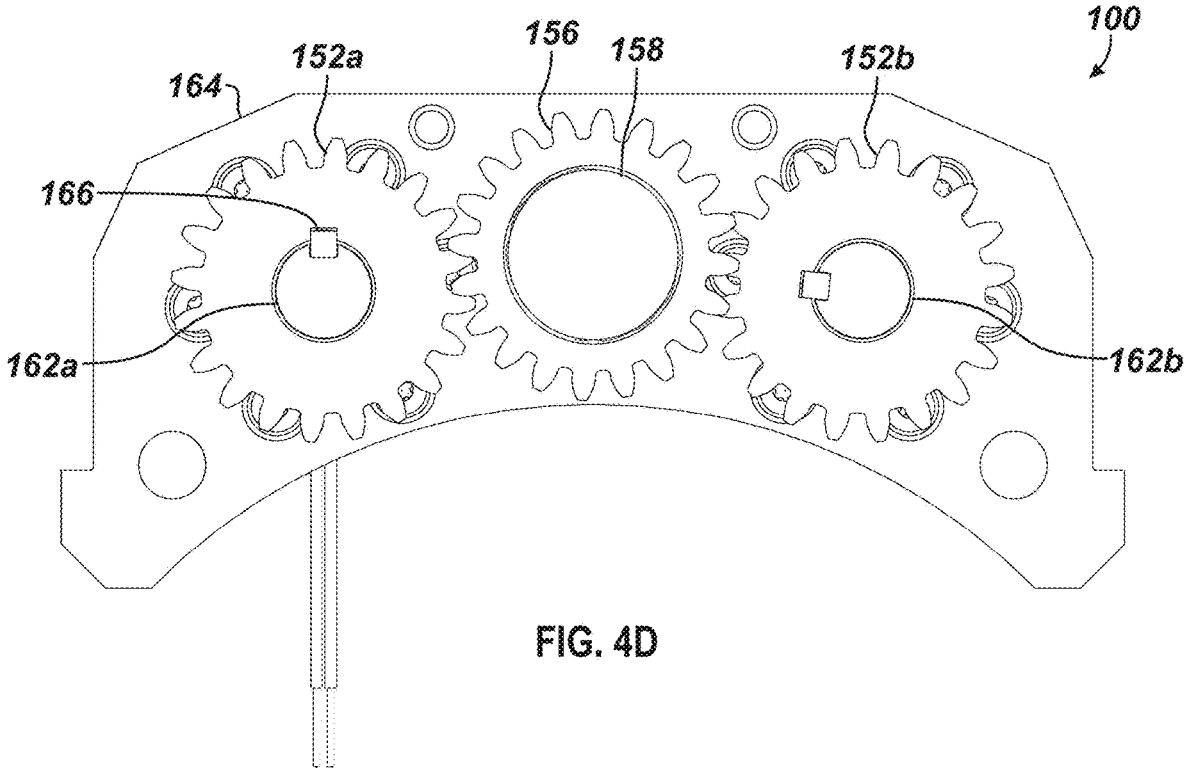
FIG. 4D illustrates an end-section of the actuator in FIG. 4A.

Turning now to a particular implementation, FIG. 4A illustrates a perspective view of an actuator 100 according to the present disclosure. FIG. 4B illustrates a detail of the actuator 100 in FIG. 4A, and FIG. 4C illustrates a cross-section of the actuator 100 in FIG. 4A. Meanwhile, FIG. 4D illustrates an end-section of the actuator 100 in FIG. 4A.

The actuator 100 includes first and second motors 160*a-b*, a gear train 150, first and second drive assemblies or roto-linear drives 110*a-b*, and a yoke 120. Each roto-linear drive 110*a-b* includes a screw 112*a-b* and a nut 114*a-b*. The first motor 160*a* is configured to produce a first drive to rotate the first screw 112*a*, and the second motor 160*b* is configured to produce a second drive to rotate the second screw 112*b*. Yet, as noted, the screws 112*a-b* rotate whether one motor 160*a-b* or both motors 160*a-b* are operated because the screws 112*a-b* are interconnected through the assembly of the nuts 114*a-b* on the yoke 120.

The nuts 114*a-b* are engaged on the threads of the screws 112*a-b* and are connected to the yoke 120. Rotation of the first screw 112*a* in one direction driven by the first motor 160*a* will cause the respective nut 114*a* engaged with the thread to ride linearly along the first screw 112*a*. If the second screw 112*b* is not being driven and the second motor's rotor simply rotates freely, then the engagement of the second screw's nut 114*b* with the screw's thread will cause the second screw 112*b* to rotate in the same direction as the second nut 114*b* is carried by the yoke 120. If, however, the second screw 112*b* is being driven by its motor 160*b* in the same direction, then the rotation the second screw 112*b* will cause the respective nut 114*b* engaged with the thread to ride linearly along the second screw 112*b* in tandem with the other nut 114*a*. Driving the screws 112*a-b* in opposite directions will seize up or lock the mechanism.

The gear train 150 includes first and second gears 152*a-b* and an intermediate gear 156. The first gear 152*a* is rotatable in association with at least the rotation of the first screw 112*a*. This is true either when the first motor 160*a* drives the first screw 112*a* to rotate or when the drive of the second motor 160*b* produces rotation in the first screw 112*a* (i.e., through the assembly of the nuts 114*a-b* on the yoke 120). In a similar fashion, the second gear 152*b* is rotatable in association with at least the rotation of the second screw 112*b*. This is true either when the second motor 160*b* drives the second screw 112*b* to rotate or when the drive of the first motor 160*a* produces rotation in the second screw 112*b* (i.e., through the assembly of the nuts 114*a-b* on the yoke 120). The intermediate gear 156 is engaged between the first and second gears 152*a-b* and is configured to synchronize/mediate/interconnect the drive/rotation between the first and second screws 112*a-b*.

The yoke 120 is disposed on the first and second screws 112*a-b* and is displaceable thereon by the drive of at least one of the first and second drive assemblies 110*a-b*. The yoke 120 is connected to the first and second nuts 114*a-b* disposed on the respective first and second screws 112*a-b*.

As shown, the drive assemblies 110*a-b* can be ball screw assemblies, each having a screw 112*a-b* and a ball nut 114*a-b*. As is typically, the ball nut 114*a-b* includes internal bearings that engage the thread of the screw 112*a-b*. Other arrangements can be used. For example, the nut 114*a-b* can simply be a threaded nut that can move along the thread of the screw 112*a-b* without the need for bearings. The screws 112*a-c* can each be a worm gear feed screw, and the yoke 120 can have (or can be connected to) a nut 114*a-b* threaded on the worm gear feed screw.

One or both of the motors 160*a-b* can be operated. For example, the rotation of only one of the first and second screws (e.g., 112*a*) in a first rotational direction by the associated motor 160*a* moves the associated ball nut 114*a* in a first linear direction along the screw's thread. The yoke 120 connected to the associated ball nut 114*a* thereby moves linearly in that first linear direction. The other ball nut 114*b* connected to the yoke 120 causes its screw 112*b* to rotate with the first rotational direction as the ball nut 114*b* is moved in the first linear direction. Reverse rotation of the one screw 112*a* in a second opposite rotation direction would produce movement in a second opposite linear direction. Rotation of only the other of the screws (e.g., 112*b*) by the associated motor 160*b* would produce comparable operation. Likewise, both motors 160*a-b* rotating the screws 112*a-b* in the same direction would produce comparable operation, but at a greater power.

In the end, the yoke 120 can be connected to an actuatable member of a downhole tool so the actuatable member can be displaced, opened, closed, etc. Thus, the yoke 120 is displaceable in a first linear direction in response to the drive of the first motor 160*a* alone in a first rotational direction, the drive of the second motor 160*b* alone in the first rotational direction, or the drive of the first and second motors 160*a-b* both in the first rotational direction. Meanwhile, the yoke 120 is displaceable in a second linear direction opposite to the first linear direction in response to the drive of the first motor 160*a* alone in the second rotational direction opposite to the first rotational direction, the drive of the second motor 160*b* alone in the second rotational direction, or the drive of the first and second motors 160*a-b* both in the second rotational direction.

As best shown in FIGS. 4B-4C, the motors 160*a-b* are mounted to a motor mount 164. The motors 160*a-b* can be electric motors having a stator and a rotor, and the rotor can extend as (or can be connected to) a drive shaft 162. Alternatively, depending on the implementation, the rotor can be connected to a gear box 161, which can have a drive shaft 162. (Internal features of the motor 160*a* and gear box 161 are not shown in the cross-sectional view of FIG. 4C.) In any event, drive shafts 162 extend beyond the motor mount 164 and can be rotated by the associated motor 160*a-b*.

As noted, the gear train 150 synchronizes the drive/rotation between the first and second screws 112*a-b*. In particular, a first drive shaft 162 is coupled to the drive of the first motor 160*a*. A first rotatable shaft or end 116*a* is part of the first screw 112*a* (or is coupled to the rotation of the first screw 112*a*). In this preferred arrangement, the first gear 152*a* couples the first drive shaft 162*a* to the first rotatable shaft 116*a*. The first gear 152*a* is configured to fit on the first drive shaft 162*a* and the first rotatable shaft 116*a*. Internally, the first gear 152*a* has a spline connection to each of these shafts 162*a*, 116*a* so rotation can be transferred. Details of the spline 166 are best shown in FIGS. 4C-4D.

The second motor 160*b* is similarly configured with a second drive shaft 162*b* coupled to the drive of the second motor 160*b*. A second rotatable shaft or end 116*b* is part of the second screw 112*b* (or is coupled to the rotation of the second screw 112*b*), and the second gear 152*b* couples the second drive shaft 162*b* to the second rotatable shaft 116*b* in a comparable configuration as discussed previously.

The mount 140 supports the first ends 116*a-b* of the first and second screws 112*a-b* adjacent one another. The screw ends 116*a-b* extend from the mount 140 for coupling with the first and second gears 152*a-b*. Bearing 142*a-b* can be used between the mount 140 and the ends 116*a-b* to accommodate rotation and load.

The intermediate gear 156 is disposed on an intermediate shaft 158 connected between the first mount 140 and the motor mount 164. In general, the intermediate gear 156 can be rotatable relative to the intermediate shaft 158, the intermediate shaft 158 can be rotatable relative to the first mount 140 and the motor mount 164, or both. Support rods (not shown) can affix between the motor mount 164 and the first mount 140 for stability.

Meanwhile, at the other end of the actuator 100, another end support or mount 130 supports second ends 113*a-b* of the first and second screws 112*a-b*. As before, the mount 130 includes bearings 132*a-b* supporting the ends 113*a-b* of the first and second screws 112*a-b* to accommodate rotation and load. As shown, the bearings 132*a-b*, 142*a-b* can be positioned outside the mounts 130, 140 so that the screws 112*a-b* of the ball screws 110*a-b* are placed in tension while displacing the yoke 120.

In the arrangement of FIGS. 4A-4D, one gear train 150 is used at the end of the actuator 100 having the motors 160*a-b*. An opposite arrangement could be used in which the gear train 150 is used at the opposite end of the actuator 100. Further still, dual gear trains 150 can be used, with one arranged at each end of the actuator 100.

Figure 5:
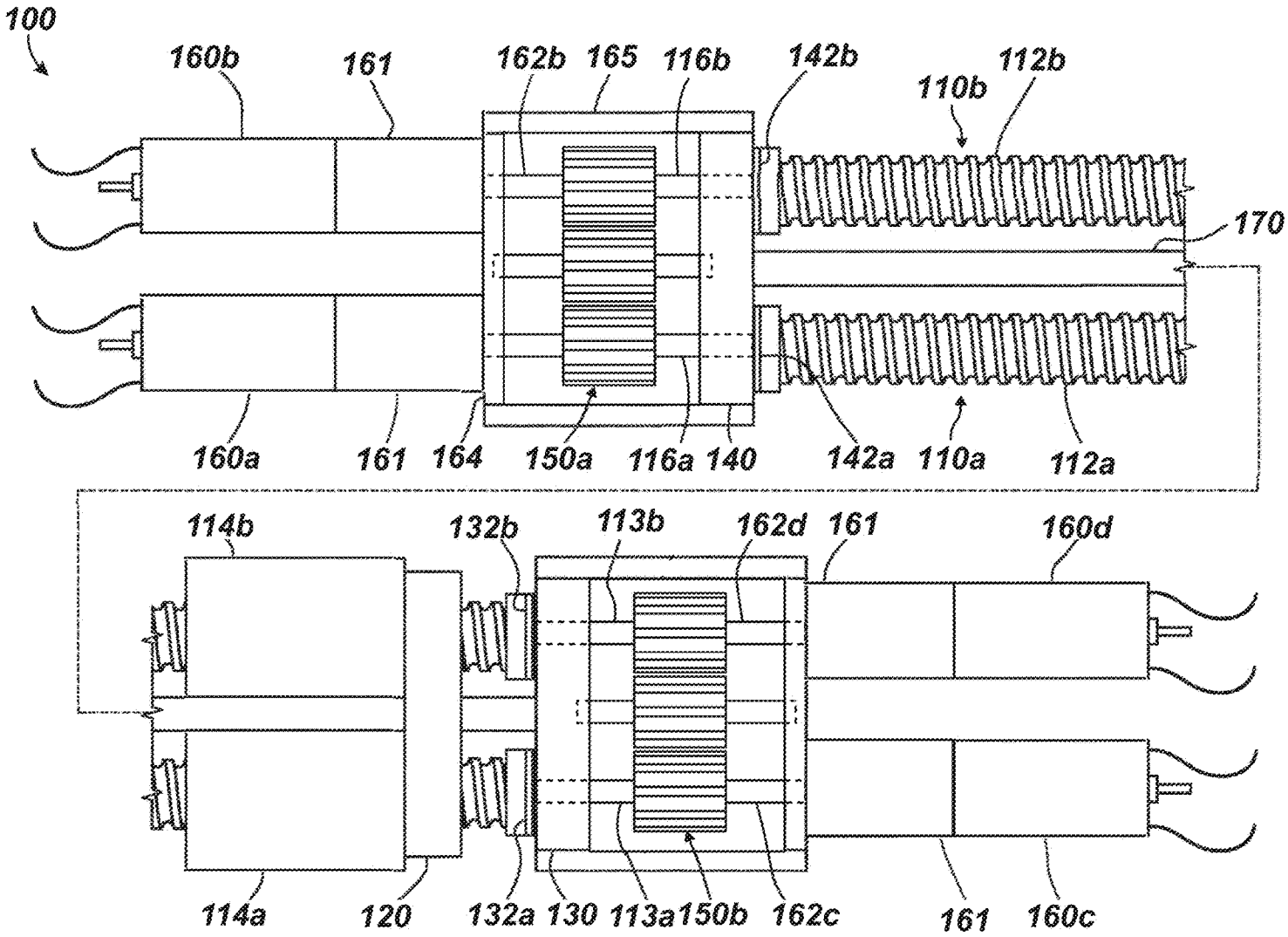
FIG. 5 illustrates a schematic view of yet another example of an actuator according to the present disclosure.

FIG. 5 illustrates a schematic view of yet another actuator 100 according to the present disclosure. The actuator 100 combines features of the previous examples. As before, the actuator 100 includes dual roto-linear drives 110*a-b*, which can be ball screw assemblies having rotatable screws 112*a-b* and ball nuts 114*a-b*. Additionally, the actuator 100 includes the load yoke 120, the position indicator bar 170, and four bearings 132*a-b*, 142*a-b*. However, the actuator 100 includes a total of four motors 160*a-ds* connected in series and in parallel.

Using the four motors 161*a-d*, the actuator 100 of FIG. 5 can further increase the linear shifting forces output by the actuator 100. As mentioned above for the dual-motor examples, linear and rotational loads are distributed over an even larger number of components, thus further enhancing the life expectancy of each of the components. The four motors 160*a-d* can be powered by a single conductor, or any set of two can be powered by a separate conductor.

The four-motor arrangement can function with the synchronization provided by one gear train 150*a*. However, the actuator 100 of FIG. 5 includes two gear trains 150*a-b* arranged at the opposing ends 113*a-b*, 116*a-b* of the ball screw assemblies 110*a-b*. Although four motors are shown in FIG. 5, the actuator 100 can have three motors.

In some examples depicted in the drawings (e.g., FIGS. 3 & 5), the bearings 132*a-b*, 142*a-b* are positioned between the screws 112*a-b* and the end supports 130, 140 connected to the support bars 144. In this configuration, the screws 112*a-b* of the ball screws 110*a-b* are placed in compression while displacing the yoke 120. In other examples depicted in the drawings (e.g., FIGS. 4A-4C), the bearings 132*a-b*, 142*a-b* may be positioned between the gear boxes 161 and torque plates 162*a-b* connected to the support bars 144, so that the screws 112*a-b* of the ball screws 110*a-b* are placed in tension while displacing the yoke 120.

Figure 6:
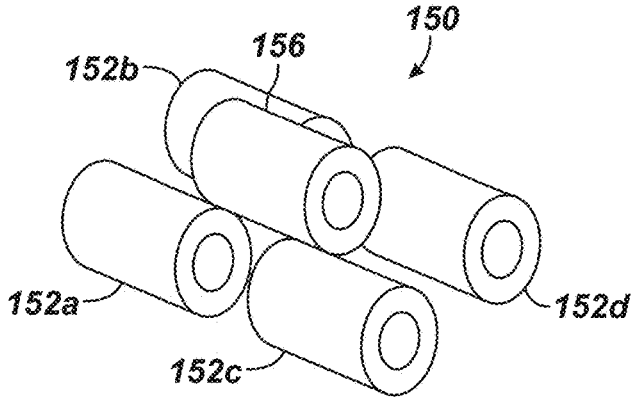
FIG. 6 illustrates a schematic arrangement of another gear set for the disclosed actuator.

As disclosed in all of the examples above, the gear train 150 has three gears 152*a-b* and 156. Other arrangements can be used. As briefly shown in FIG. 6, for example, a gear train 150 comprising five gears can be used. First gears 152*a-b* are used for the drive shafts from the motors, and second gears 152*c-d* are used for the ends of the screws. A center, idler gear 156 interconnects the four gears 152*a-d*. This center gear 156 would have its own shaft.

As noted, the use of dual motors 160*a-b* as in FIGS. 3 and 4A-4D allows a higher load rating from the actuator 100 as well as the ability of packaging in a smaller housing as opposed to a relatively bigger single motor and ball screw assembly to achieve similar load ratings. The combined gear train 150 and coupling concept allows the use of dual motors 160*a-b* and ball screw assemblies 110*a-b* to achieve higher load ratings and eliminates the problems with dual motors due to motor speed synchronization.

In summary, the actuator 100 disclosed with reference to FIGS. 3 through 5 uses a mechanical system (e.g., gear train) 150 to tie multiple motors 160 and roto-linear drives or drive assemblies 110 (e.g., ball screw assemblies) together. The gear train 150 can use gears 152 that span across both the drive shaft and screw shafts so the gears 152 act as both gears and couplings. The gear train 150 can compensate for the speed difference between the motors 160 by preventing a faster motor 160 from getting ahead of a slower motor 160. Additionally, the gear train 150 can make the two screws 112*a-b* of the drive assemblies 110*a-b* rotate at the same speed as a result, and this can prevent the actuator 100 from seizing or locking up. If one motor 160 tries to rotate faster than another, that motor 160 will experience an increased load which will, due to its speed/torques gradient, slow the motor 160 down until its speed equals that of the slower motor 160.

The intermediate gear 156 interconnects the rotation of the two screws 112*a-b* forcing the two screws 112*a-b* to rotate at the same speed. Likewise, the intermediate gear 156 balances the drive of the motors 160 forcing the two screws 112*a-b* to rotate at the same speed. The gear train 150 allows one motor 160 to override the other motor 160 if failed, thus giving motor redundancy. In a scenario where one motor 160 fails and the other motor 160 is functional, the actuator 100 will still be able to function but will have a reduced load capacity. Yet, torque is supplied to both screws 112*a-b* at the same end of the actuator 100 by the one operating motor 160, which means the operation will be more stable and will experience less unbalanced twisting.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool for use in a well, the downhole tool comprising:

an actuator comprising:

a first screw being rotatable and having a first proximal end;

a first motor being configured to produce a first drive to rotate a first drive shaft;

a first gear having a first spline connection to the first drive shaft and the first proximal end of the first screw, the first gear being rotatable and transferring first rotation to the first screw;

a second screw being rotatable and having a second proximal end;

a second motor being configured to produce a second drive to rotate a second drive shaft;

a second gear having a second spline connection to the second drive shaft and the second proximal end, the second gear being rotatable and transferring second rotation to the second screw;

an intermediate gear engaged between the first and second gears and being configured to synchronize the first and second rotations of the first and second screws as a synchronized rotation produced by at least one of the first and second drives; and a yoke disposed on the first and second screws and being displaceable thereon by the synchronized rotation; and an actuatable member of the downhole tool connected to the yoke of the actuator and being actuatable in response to the displacement of the yoke.

2. The downhole tool of claim 1, wherein the first drive shaft is a rotor of the first motor or is a gear shaft of a gear box coupled to the rotor of the first motor.

3. The downhole tool of claim 1, wherein the yoke comprises:

a first portion threadably engaged with the first screw; and a second portion threadably engaged with the second screw.

4. The downhole tool of claim 1, wherein the first and second screws each comprises a worm gear feed screw, and the yoke comprises a first nut and a second nut disposed on the respective worm gear feed screw; or wherein each of the first and second screws is a rotatable screw of a ball screw assembly, and the yoke comprises a first ball nut and a second ball nut of the ball screw assemblies disposed on the respective rotatable screw.

5. The downhole tool of claim 1, comprising:

a first mount supporting the first and second proximal ends of the first and second screws adjacent one another; and first bearings supporting the first and second proximal ends of the first and second screws on the first mount.

6. The downhole tool of claim 5, comprising a motor mount having the first and second motors mounted thereon, wherein the intermediate gear is disposed on an intermediate shaft connected between the first mount and the motor mount.

7. The downhole tool of claim 6, wherein the intermediate gear is rotatable relative to the intermediate shaft, the intermediate shaft is rotatable relative to the first mount and the motor mount, or both.

8. The downhole tool of claim 5, comprising:

a second mount supporting first and second distal ends of the first and second screws adjacent one another; and second bearings supporting the first and second distal ends of the first and second screws on the second mount.

9. The downhole tool of claim 1, wherein the yoke is displaceable in a first linear direction in response to the first drive of the first motor alone in a first rotational direction, the second drive of the second motor alone in the first rotational direction, or the first and second drives of the first and second motors both in the first rotational direction; and wherein the yoke is displaceable in a second linear direction opposite to the first linear direction in response to the first drive of the first motor alone in a second rotational direction opposite to the first rotational direction, the second drive of the second motor alone in the second rotational direction, or the first and second drives of the first and second motors both in the second rotational direction.

10. The downhole tool of claim 1, wherein the downhole tool is a valve, a packer, a fluid sampler, a formation tester, a pump, an inflow control device, a safety valve, or an interval control valve.

11. The downhole tool of claim 1, wherein the downhole tool is an interval control valve comprising a housing having a bore and at least one side port; and wherein the actuatable member comprises a sliding sleeve disposed in the bore and connected to the yoke, the sliding sleeve being movable relative to the at least one side port in response to the displacement of the yoke.

12. An actuator for actuating a member of a downhole tool used in a well, the actuator comprising:

a first screw being rotatable and having a first proximal end;

a first motor being configured to produce a first drive to rotate a first drive shaft;

a first gear having a first spline connection to the first drive shaft and the first proximal end of the first screw, the first gear being rotatable and transferring first rotation to the first screw;

a second screw being rotatable and having a second proximal end;

a second motor being configured to produce a second drive to rotate a second drive shaft;

a second gear having a second spline connection to the second drive shaft and the second proximal end, the second gear being rotatable and transferring second rotation to the second screw;

a third gear, wherein the third gear is a first intermediate gear engaged between the first and second gears and being configured to synchronize the first and second rotations of the first and second screws as a synchronized rotation produced by at least one of the first and second drives; and a yoke disposed on the first and second screws and being displaceable thereon by the synchronized rotation.

13. The actuator of claim 12, wherein the first and second motors are disposed at the first and second proximal ends of the first and second screws; and wherein the actuator further comprises third and fourth motors disposed at first and second distal ends of the first and second screws opposite to the first and second proximal ends, the third motor configured to produce a third drive to rotate the first screw, the fourth motor configured to produce a fourth drive to rotate the second screw.

14. The actuator of claim 12, wherein the actuator further comprises:

a fourth gear disposed toward a first distal end of the first screw and being rotatable in association with at least the first rotation;

a fifth gear disposed toward a second distal end of the second screw and being rotatable in association with at least the second rotation; and a sixth gear, wherein the sixth gear is a second intermediate gear engaged between the fourth and fifth gears and being configured to synchronize the first and second rotations.

15. The actuator of claim 12, wherein the first drive shaft is a rotor of the first motor or is a gear shaft of a gear box coupled to the rotor of the first motor.

16. The actuator of claim 12, wherein each of the first and second screws comprises a worm gear feed screw, and the yoke comprises nuts disposed on the respective worm gear feed screw; or wherein each of the first and second screws comprises a rotatable screw of a ball screw assembly, and the yoke comprises ball nuts of the ball screw assemblies disposed on the respective rotatable screw.

17. The actuator of claim 12, comprising:

a first mount supporting the first and second proximal ends of the first and second screws adjacent one another; and a second mount having the first and second motors mounted thereon, wherein the first intermediate gear is disposed on an intermediate shaft connected between the first and second mounts; and wherein the first intermediate gear is rotatable relative to the intermediate shaft, the intermediate shaft is rotatable relative to the first and second mounts, or both.

18. A downhole tool for use in a well, the downhole tool comprising:

an actuator comprising:

a first motor being configured to produce a first drive;

a first gear being rotatable in association with the first drive;

a second motor being configured to produce a second drive;

a second gear being rotatable in association with the second drive;

a first roto-linear drive having a third gear;

a second roto-linear drive having a fourth gear;

an intermediate gear being rotatable and having first and second portions, the first portion of the intermediate gear engaged between the first and second gears and being configured to synchronize the first and second drives as a synchronized drive, the second portion of the intermediate gear engaged between the third and fourth gears and being configured to transfer the synchronized drive to a synchronized rotation for the first and second roto-linear drives; and a yoke disposed on the first and second roto-linear drives and being displaceable thereon by the synchronized rotation produced by at least one of the first and second drives; and an actuatable member of the downhole tool connected to the yoke of the actuator and being actuatable in response to the displacement of the yoke.

19. The downhole tool of claim 18, wherein each of the first and second roto-linear drives comprises a worm gear feed screw, and the yoke comprises nuts disposed on the respective worm gear feed screws; or wherein each of the first and second roto-linear drives comprises a rotatable screw of a ball screw assembly, and the yoke comprises ball nuts of the ball screw assemblies disposed on the respective rotatable screws.

20. The downhole tool of claim 18, comprising:

a first mount supporting the first and second roto-linear drives adjacent one another;

a second mount having the first and second motors mounted thereon, wherein the intermediate gear is disposed on an intermediate shaft connected between the first and second mounts; and wherein the intermediate gear is rotatable relative to the intermediate shaft, the intermediate shaft is rotatable relative to the first and second mounts, or both.

21. The downhole tool of claim 18, wherein the downhole tool comprises a housing having a bore and at least one side port; and wherein the actuatable member comprises a sliding sleeve disposed in the bore and connected to the yoke, the sliding sleeve being movable relative to the at least one side port in response to the displacement of the yoke.

* * * * *